US008763523B2

(12) United States Patent
McNeil et al.

(10) Patent No.: US 8,763,523 B2
(45) **Date of Patent: *Jul. 1, 2014**

(54) METHOD OF PERFORATING A WEB MATERIAL

(75) Inventors: Kevin Benson McNeil, Loveland, OH (US); André Mellin, Amberley Village, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 353 days.

This patent is subject to a terminal disclaimer.

(21) Appl. No.: 12/819,324

(22) Filed: Jun. 21, 2010

(65) Prior Publication Data

US 2011/0308372 A1 Dec. 22, 2011

(51) Int. Cl.
*B41F 19/02* (2006.01)
*B26D 3/08* (2006.01)

(52) U.S. Cl.
USPC ..... 101/23; 101/32; 162/117; 162/362; 492/36

(58) Field of Classification Search
USPC ..... 101/22–24, 26, 30, 226; 83/660, 663, 83/667, 668, 674, 684, 691, 694; 425/DIG. 37; 162/114, 117; 492/30, 36, 492/28; 493/58, 59, 63, 47
See application file for complete search history.

(56) References Cited

U.S. PATENT DOCUMENTS

| | | | |
|---|---|---|---|
| 405,412 | A | 6/1889 | Hicks |
| 453,003 | A | 5/1891 | Hicks |
| 714,652 | A | 11/1902 | Davis |
| 1,170,589 | A | 2/1916 | Wheeler |
| 3,467,250 | A | 9/1969 | D'Elia et al. |
| 3,583,558 | A | 6/1971 | Davis |
| 3,752,304 | A | 8/1973 | Alef |
| 3,762,542 | A | 10/1973 | Grimes |
| 3,770,172 | A | 11/1973 | Nystrand et al. |
| 3,931,886 | A | 1/1976 | Yamauchi |
| 4,029,938 | A | 6/1977 | Martin |
| 4,035,611 | A | 7/1977 | Martin et al. |
| 4,100,396 | A | 7/1978 | Martin |
| 4,199,090 | A | 4/1980 | Reed |
| 4,210,688 | A | 7/1980 | Sato |
| 4,219,727 | A | 8/1980 | Bolt |
| 4,220,490 | A | 9/1980 | Carlson |

(Continued)

FOREIGN PATENT DOCUMENTS

| | | | |
|---|---|---|---|
| DE | 3043845 | A1 | 10/1981 |
| DE | 20013469 | U1 | 11/2000 |

(Continued)

OTHER PUBLICATIONS

U.S. Appl. No. 12/819,271, filed Jun. 21, 2010, Hupp, Vaughn, Singer.

(Continued)

*Primary Examiner* — Leslie J Evanisko
*Assistant Examiner* — Justin Olamit
(74) *Attorney, Agent, or Firm* — Peter D. Meyer

(57) ABSTRACT

Methods are disclosed which include forming selected perforation designs and patterns. The perforation designs and patterns can be formed in linear or nonlinear fashion, can extend in the cross direction or the machine direction and can be formed to complement or match an embossed or printed design on the web. The perforation designs and patterns can be formed utilizing various mechanical perforating techniques.

17 Claims, 6 Drawing Sheets

(56) References Cited

U.S. PATENT DOCUMENTS

| | | | | |
|---|---|---|---|---|
| 4,247,754 | A | 1/1981 | Baier | |
| 4,355,226 | A | 10/1982 | Hall | |
| 4,423,101 | A | 12/1983 | Willstead | |
| 4,441,952 | A | 4/1984 | Mullane, Jr. | |
| 4,457,964 | A | 7/1984 | Kaminstein | |
| 4,500,770 | A | 2/1985 | Vock et al. | |
| 4,503,318 | A | 3/1985 | Hall | |
| 4,509,908 | A | 4/1985 | Mullane, Jr. | |
| 4,636,161 | A | 1/1987 | Raley et al. | |
| 4,646,364 | A | 3/1987 | O'Larey | |
| 4,806,303 | A | 2/1989 | Bianco et al. | |
| 4,842,794 | A | 6/1989 | Hovis et al. | |
| 4,884,719 | A | 12/1989 | Levine et al. | |
| 4,957,122 | A | 9/1990 | Maldina et al. | |
| 4,995,930 | A | 2/1991 | Merz et al. | |
| 5,041,317 | A | 8/1991 | Greyvenstein | |
| 5,062,331 | A | 11/1991 | Michal et al. | |
| 5,133,235 | A * | 7/1992 | DeVito | 83/347 |
| 5,198,276 | A | 3/1993 | Nakajima | |
| 5,202,077 | A | 4/1993 | Marco et al. | |
| 5,205,454 | A | 4/1993 | Schutz et al. | |
| 5,246,110 | A | 9/1993 | Greyvenstein | |
| 5,313,863 | A * | 5/1994 | Aihara et al. | 83/171 |
| 5,453,311 | A | 9/1995 | Svensson | |
| 5,613,347 | A | 3/1997 | Weder | |
| 5,616,387 | A | 4/1997 | Augst et al. | |
| 5,704,566 | A | 1/1998 | Schutz et al. | |
| 5,718,928 | A | 2/1998 | Rieker | |
| 5,727,458 | A | 3/1998 | Schulz | |
| 5,740,657 | A | 4/1998 | Weder | |
| 5,740,658 | A | 4/1998 | Weder | |
| D393,950 | S | 5/1998 | Lockhart | |
| 5,755,654 | A | 5/1998 | Schulz et al. | |
| 5,789,050 | A | 8/1998 | Kang | |
| 5,839,688 | A | 11/1998 | Hertel et al. | |
| 6,010,090 | A | 1/2000 | Bushmaker et al. | |
| 6,029,921 | A | 2/2000 | Johnson | |
| 6,119,439 | A | 9/2000 | Stevie | |
| 6,136,209 | A | 10/2000 | Kang | |
| 6,139,186 | A | 10/2000 | Fraser | |
| 6,223,641 | B1 | 5/2001 | Kang | |
| 6,289,777 | B1 | 9/2001 | Hartmann et al. | |
| 6,460,727 | B1 | 10/2002 | Irwin | |
| 6,487,762 | B1 | 12/2002 | Fleissner | |
| 6,557,224 | B2 | 5/2003 | Fleissner | |
| 6,565,794 | B1 | 5/2003 | Fraser | |
| 6,733,626 | B2 * | 5/2004 | Ruthven et al. | 162/114 |
| 6,735,834 | B2 | 5/2004 | Fleissner | |
| 6,838,040 | B2 | 1/2005 | Mlinar et al. | |
| 6,865,784 | B2 | 3/2005 | Noelle | |
| 7,089,854 | B2 | 8/2006 | McNeil | |
| 7,222,346 | B2 | 5/2007 | Lenormand et al. | |
| 2002/0148085 | A1 | 10/2002 | Fleissner | |
| 2003/0101557 | A1 | 6/2003 | Fleissner | |
| 2003/0111169 | A1 | 6/2003 | Baggot et al. | |
| 2003/0131454 | A1 | 7/2003 | Noelle | |
| 2003/0132549 | A1 | 7/2003 | Mlinar et al. | |
| 2003/0218040 | A1 | 11/2003 | Faulks et al. | |
| 2005/0095403 | A1 | 5/2005 | Noelle | |
| 2005/0241788 | A1 | 11/2005 | Baggot et al. | |
| 2007/0014961 | A1 | 1/2007 | Schneider et al. | |
| 2007/0209099 | A1 | 9/2007 | Issachar | |
| 2008/0280088 | A1 | 11/2008 | Baum | |
| 2009/0022927 | A1 | 1/2009 | Strobel et al. | |

FOREIGN PATENT DOCUMENTS

| | | | |
|---|---|---|---|
| DE | 102006049680 | A1 | 4/2008 |
| EP | 0 054 907 | A2 | 6/1982 |
| EP | 0 195 113 | A2 | 9/1986 |
| EP | 0 689 819 | A2 | 1/1996 |
| EP | 0 974 433 | A1 | 1/2000 |
| EP | 1 529 477 | A1 | 5/2005 |
| FR | 2292560 | A1 | 6/1976 |
| GB | 1598188 | A | 9/1981 |
| GB | 2183489 | A | 6/1987 |
| GB | 2184390 | A | 6/1987 |
| GB | 2184391 | A | 6/1987 |
| JP | 08-084685 | A | 4/1996 |
| JP | 9-279463 | A | 10/1997 |
| JP | 11-091266 | A | 4/1999 |
| JP | 3-140786 | B2 | 3/2001 |
| JP | 2002-017607 | A | 1/2002 |
| JP | 2004-049261 | A | 2/2004 |
| JP | 2005-153997 | A | 6/2005 |
| JP | 2005-296588 | A | 10/2005 |
| JP | 2006-247311 | A | 9/2006 |
| JP | 2007-117466 | A | 5/2007 |
| WO | WO-92/03250 | A2 | 3/1992 |
| WO | WO-03/026472 | A1 | 4/2003 |
| WO | WO-2006/067260 | A1 | 6/2006 |
| WO | WO-2008/068723 | A1 | 6/2008 |
| WO | WO-2008/141598 | A1 | 11/2008 |
| WO | WO 2010/076689 | A1 | 8/2010 |

OTHER PUBLICATIONS

U.S. Appl. No. 12/819,277, filed Jun. 21, 2010, Hupp, Singer.
U.S. Appl. No. 12/819,286, filed Jun. 21, 2010, Hupp.
U.S. Appl. No. 12/819,296, filed Jun. 21, 2010, McNeil, Melliln.
U.S. Appl. No. 12/819,344, filed Jun. 21, 2010, McNeil, Mellin.
U.S. Appl. No. 12/819,367, filed Jun. 21, 2010, McNeil, Singer.
U.S. Appl. No. 12/819,380, filed Jun. 21, 2010, McNeil, Singer.
U.S. Appl. No. 12/819,388, filed Jun. 21, 2010, McNeil, Singer.
U.S. Appl. No. 12/819,399, filed Jun. 21, 2010, Redd.
U.S. Appl. No. 12/819,420, filed Jun. 21, 2010, Kien, Redd.
U.S. Appl. No. 12/819,434, filed Jun. 21, 2010, Feldmann, Kien.
Anon, "Easycut—The Fast Way to Open a Product," *Packag. Rev.*, 24(5):31 (1998), Accession No. A20114701.
Klemm, "A Guide to Laser Cutting Technology, Part 1," *Screen Print*, 99(2):24-29 (2009), Accession No. A20331589.
Perkins et al., "Stress and Strain for Perforated Tensile Specimens, Part 2: FEA Simulations," *Tappi J.*, 6(4):22-27 (2007), Accession No. A20301227.

* cited by examiner

METHOD OF PERFORATING A WEB MATERIAL

FIELD OF THE INVENTION

The present invention relates generally to methods for perforating a web material. More particularly the present invention relates to methods of this type having significantly improved reliability, lower manufacturing costs, greater flexibility, and higher perforation quality.

BACKGROUND OF THE INVENTION

For many years, it has been well known to perforate products manufactured from webs such as paper towels, toilet tissue and the like to thereby facilitate the removal of sheets from a roll by tearing. There have been proposed a variety of types of mechanical apparatus and numerous different methods for forming the perforations for these products. Typically, a moving blade has been utilized to perforate a web as it passes between the moving blade and a stationary anvil wherein the moving blade extends perpendicular to the direction of travel of the web.

While this conventional operation has been widely adopted, there are a number of well known drawbacks in terms of the overall reliability, manufacturing costs, flexibility, and perforation quality. Among the drawbacks is the fact that the interaction of the moving blade and the stationary anvil is known to impose a speed limitation since vibrations produced at high speeds adversely affect the overall quality of the perforations formed in a web. Further, the vibrations caused by the interaction of the moving blade and stationary anvil may result in costly web breaks or equipment malfunctions requiring a shutdown of the manufacturing operation.

For instance, it is known that the teeth on the moving blade become dull or broken after a period of use. This not only will result in an inferior and unacceptable level of perforation quality, but it will also require a temporary shutdown of the manufacturing operation to replace the moving blade and to discard inferior product produced immediately prior to shutdown. As will be appreciated, this results in unacceptable waste and significantly increased manufacturing costs.

In addition, another drawback to conventional equipment has been the inability to quickly change from one perforation pattern format (or sheet length) to another without significant down time for the changeover. It has typically been the case that this type of changeover requires the manufacturing operation to be shut down for at least several hours. While the changeover is occurring, there is obviously no product being produced and personnel must be actively engaged in implementing the changeover, all of which leads to significantly increased manufacturing costs.

In another respect, there has been a continuing need for greater flexibility in order to produce products having enhanced consumer desirability. For instance, it would be desirable to be able to produce both linear and nonlinear perforations as well as perforations extending in both the cross and machine directions. While various approaches have been suggested, none have offered the requisite level of perforation quality that would result in a fully acceptable product.

Additionally, it would be desirable to have perforations that are sufficiently strong to withstand winding of a web but also sufficiently weaken the web at least at the edges to facilitate the separation of one sheet from the next. Further, it would be desirable to have a wound or rolled perforated web product which is manufactured in such a manner that is possible for a line of perforations to complement, register with, or match an embossed or printed pattern on the web.

While various efforts have been made in the past which were directed to overcoming one or more of the foregoing problems and/or to providing one or more of the foregoing features, there remains a need for perforating apparatuses and methods and perforated web products having improved reliability, lower manufacturing costs, greater flexibility, and higher perforation quality.

SUMMARY OF THE INVENTION

While it is known to manufacture perforated web products such as paper towels, toilet tissue and the like to facilitate the removal of sheets from a roll by tearing, it has remained to provide perforating apparatuses and methods and perforated web products which overcome the noted problems and provide the noted features. Embodiments of the present disclosure provide perforating apparatuses and methods and perforated web products having improved features which result in multiple advantages including enhanced reliability, lower manufacturing costs, greater flexibility, and higher perforation quality. Such apparatuses and methods not only overcome the noted problems with currently utilized conventional manufacturing operations, but they also make it possible to design and produce perforated products such as paper towels, toilet tissue, and the like having enhanced practical and aesthetic desirability for the consumer.

In certain embodiments, the apparatus and method utilize a rotatable male roll and a rotatable female roll wherein a pocket in the female roll is located to receive perforating elements on the male roll during rotation. Further, the apparatus and method cause rotation to be imparted to the male and female rolls while the web is transported between them to cause the pocket to receive the perforating elements to form a selected perforation pattern.

In these embodiments, the apparatus and method cause the male roll to be positioned in relation to the female roll such that web engaging edges defined by the perforating elements on the male roll are closely spaced from a web supporting edge defined by the pocket in the female roll. Specifically, the web engaging edges on the male roll are closely spaced from the web supporting edge of the female roll by a distance permitting the web engaging edges to overstrain the web without contacting the web supporting edge when the perforating elements are received in the pocket.

In the apparatus and method of these embodiments, a female embossing pattern may be provided on an outer surface of the female roll and a male embossing pattern may be provided for engagement with the female embossing pattern to form a selected embossing pattern on the web. The web engaging edges and the web supporting edge may then be located in relation to the respective male and female embossing patterns so the selected perforation pattern is formed by overstraining the web to complement, register with, or match the selected embossing pattern. Additionally, the apparatus and method may utilize a pair of male rolls and a female roll having a pair of pockets so each of the pockets in the female roll is adapted to receive the perforating elements on a different one of the male rolls when it is placed in an operative position.

Specifically, the male rolls are each adapted to be moved from an inoperative position to an operative position relative to the female roll. The perforating elements on each of the male rolls are suitably located at a different circumferential position to be received within a different one of the pockets in the female roll. In this manner, it is possible to move a selected one of the male rolls to an operative position to produce one of two different perforation pattern formats.

In certain embodiments, a web product is formed of paper or a like material having one or more plies and having a first side and a second side including a plurality of spaced apart and repeating lines of perforation. The repeating lines of perforation each may comprise a plurality of individually located web overstrain points. The web overstrain points extend substantially from the first to the second side of the web and are selectively located relative to adjacent web overstrain points to provide a selected perforation pattern for the repeating lines of perforation.

DETAILED DESCRIPTION OF THE INVENTION

As used herein, the term "machine direction" (MD) means the direction of travel of a web through any processing equipment. The term "cross direction" (CD) is orthogonal and coplanar thereto. The term "Z-direction" is orthogonal to both the machine and cross directions.

The various embodiments of the present disclosure described in detail below provide several non-limiting examples of perforating apparatuses, methods, and several distinct perforated web products having improved features which result in enhanced reliability, lower manufacturing costs, greater flexibility, and higher perforation quality. With regard to these non-limiting examples, the described apparatuses and methods make it possible to effectively and efficiently design and produce a variety of different perforated web products having enhanced practical and aesthetic desirability.

Figure 3:
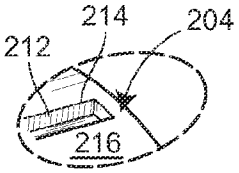
FIG. 3 is a detailed view of the region labeled 3 of FIG. 1.
Figure 1:
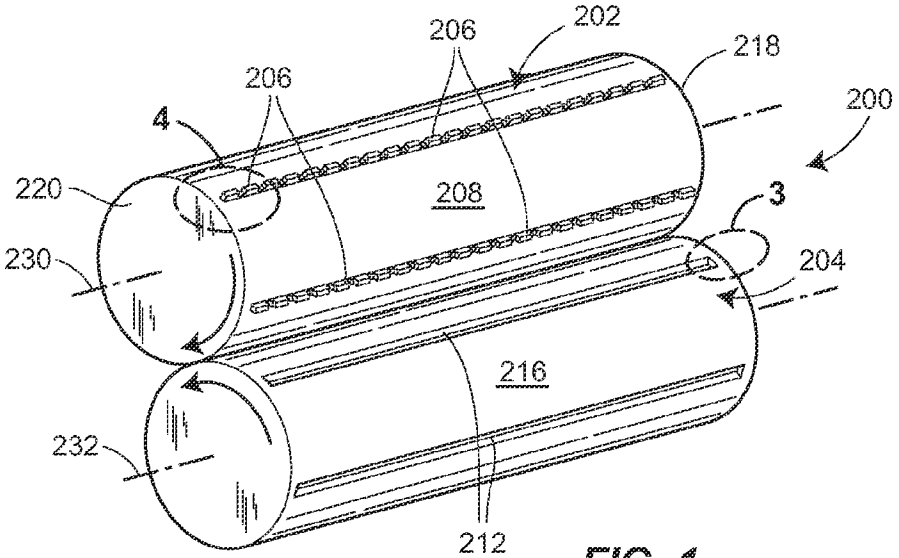
FIG. 1 is a perspective view of an exemplary apparatus for perforating a web utilizing a rotatable male roll having perforating elements defining web engaging edges and a rotatable female roll having a pocket for receiving the perforating elements and defining a web supporting edge.

Referring to FIG. 1, an exemplary apparatus 200 for perforating a web includes a rotatable male roll 202 and a rotatable female roll 204. The male roll 202 includes perforating elements 206 that define web engaging edges 206*a*. The web engaging edge 206*a* of each of the perforating elements 206 is spaced outwardly from an outer surface 208 of the male roll 202 for overstraining a web 210 (see also FIGS. 2 and 4). The female roll 204 is provided with at least one pocket 212 that defines a web supporting edge 214. The pocket 212 defines the web supporting edge 214 and extends inwardly to define a recess in an outer surface 216 of the female roll 204 to receive the perforating elements 206 and web 210 therein. FIGS. 1-4 detail how the pocket 212 in the female roll 204 receives the perforating elements 206 and web 210.

Figure 2:
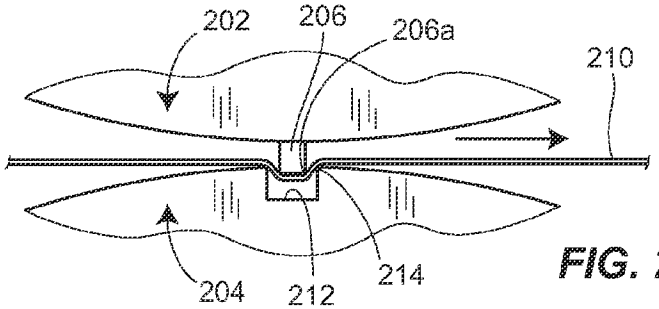
FIG. 2 is a side elevational view showing the exemplary apparatus for perforating a web of FIG. 1 perforating element overstraining a web.

In particular, FIGS. 1 and 2 illustrate that the perforating so that the pocket 212 in the female roll 204 receives the perforating elements 206 on the male roll 202 during rotation of the male roll 202 and the female roll 204. More specifically, the male roll 202 is positioned relative to the female roll 204 so the web engaging edges 206*a* are closely spaced from the web supporting edge 214 by a distance selected to permit the web engaging edges 206*a* to overstrain the web 210 without making contact with the web supporting edge 214. In other words, when the perforating elements 206 on the male roll 202 are received in the pocket 212 in the female roll 204 as illustrated in FIG. 2, the web engaging edges 206*a* defined by the perforating elements 206 will be closely spaced from, but not make contact with, the web supporting edge 214.

As shown in FIG. 2, the web 210 is transported along a path between the male roll 202 and the female roll 204 by a device which may comprise a conventional web re-winder as is well known in the art. In addition, rotation is imparted to the male roll 202 and the female roll 204 by a conventional motor and gear arrangement as is also well known in the art. In this manner, the perforating elements 206 are arranged for pushing the web 210 into the pocket 212 to force the web 210 against the web supporting edge 214 during rotation of the male and female rolls.

As will be appreciated, the web engaging edge 206*a* defined by each of the perforating elements 206 on the male roll 202 overstrains the web 210 at a single location in cooperation with the web supporting edge 214. FIG. 2 illustrates that the male roll 202 is positioned in relation to the female roll 204 to provide a selected degree of overstraining by selecting a predetermined distance for the web engaging edge 206*a* to extend into the pocket 212 and selecting the distance the web engaging edge 206*a* is spaced from the web supporting edge 214. By selecting these two distances, it is possible to control the degree of web engagement which in turn controls the degree of web overstraining and therefore the size and characteristics of the perforations.

Since the degree to which the web 210 is overstrained can be controlled, the weakening of a selected area can be accomplished without the web engaging edge 206*a* ever contacting the web supporting edge 214 or the bottom of the pocket 212 by disrupting the fiber structure of the web 210 by a desired amount up to and including a condition wherein the web 210 has been sheared.

As used throughout the specification and claims, the word "overstrain" and any variants thereof means either 1) to disrupt the fiber structure of a web to weaken it by compressing or moving the fibers apart, or 2) to deflect or displace a web in the "Z" direction, i.e., perpendicular to the plane or surface of a web, or 3) to deflect or displace a web sufficiently to provide a visually perceptible perforation, or 4) to extend completely through a web, facilitating tearing by a consumer at defined locations, e.g., along rolls of paper towels, bath tissue, and the like.

As used throughout the specification and claims, the phrase "degree of overstraining" and any variants thereof means either 1) the extent to which the fibers in a web are compressed or moved apart, or 2) the extent to which the web is deflected or displaced in the "Z" direction, i.e., the direction perpendicular to the plane or surface of a web, or 3) the size of openings which are formed in a web, which determines the strength or weakness of the web after a selected perforation design has been formed in the web.

Figure 4:
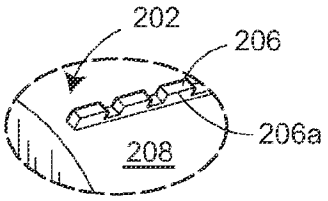
FIG. 4 is a detailed view of the region labeled 4 of FIG. 1.

Additionally, and as used throughout the specification and claims, the phrase "degree of weakening" and any variants thereof, means the extent to which the strength of the web material between successive sheets has been weakened as a result of penetration of the web by perforating elements which can be controlled by selecting the size and/or the shape of each of the perforating elements 206. Specifically, the size of each of the perforating elements 206 including all of its dimensions including but not limited to its depth or length and/or its perimeter dimension and/or its breadth as well as its shape (e.g., FIGS. 2 and 4 provide one example of the wide variety of shapes that can be utilized to form perforations in a web) may be individually selected to provide the perforating elements with the same or different depths or lengths and/or perimeter dimensions and/or breadths and/or shapes or footprints of engagement with the web to thereby control the degree of weakening of the web (e.g., in the cross and/or machine directions). Furthermore, the depths to which the perforating elements 206 extend can be controlled not only by varying the lengths of some or all of the perforating elements 206 but also by controlling the distance between the respective axes of the rotatable male roll and the rotatable female roll to thereby control the extent to which the perforating elements 206 extend into the pocket formed in the female roll.

By employing one or more of these techniques, each line of perforation can be provided with a differential perforation strength. For instance, the perforations in the cross direction of the web 210 can be formed to be weaker at or near the edges of the web 210 than the perforations in the middle of the web 210 to facilitate starting a tear of one sheet from the next adjacent sheet on the web 210. In this manner, the perforations in the middle of the web 122 can be stronger so the web 210 can withstand material handling forces during manufacturing.

Referring to the relationship between the perforating elements 206 and the pocket 212 in FIG. 2, the pocket 212 forms a recess in the outer surface 216 of the female roll 204 and is larger, i.e., deeper and wider, than the perforating elements 206 extending outwardly from the outer surface 208 of the male roll 202. This relationship of sizes between the perforating elements 206 and the pocket 212 serves to permit the perforating elements 206 to be received within the pocket 212 without actually making contact with any of the surfaces defining the pocket 212 as both the male roll 202 and the female roll 204 rotate about their respective axes. As shown in FIGS. 1 and 2, the perforating elements 206 extend outwardly from the outer surface 208 of the male roll 202 and the pocket 212 extends inwardly of the outer surface 216 of the female roll 204 in generally radial directions relative to the male roll 202 and the female roll 204 respectively.

While there are multiple sets of the perforating elements 206 and pockets 212 provided on the male roll 202 and in the female roll 204, respectively, in the non-limiting example of FIG. 1, it will be appreciated that only a single set is required. Typically, although not required, when multiple sets of the perforating elements 206 and pockets 212 are used, they will be equally circumferentially spaced about the outer surface 208 of the male roll 202 and the outer surface 216 of the female roll 204, respectively. In this connection, there will be a separate pocket 212 to receive each one of the multiple sets of perforating elements 206 during rotation of the male roll 202 and the female roll 204 for forming repeating lines of perforation in the web 210.

Figure 5:
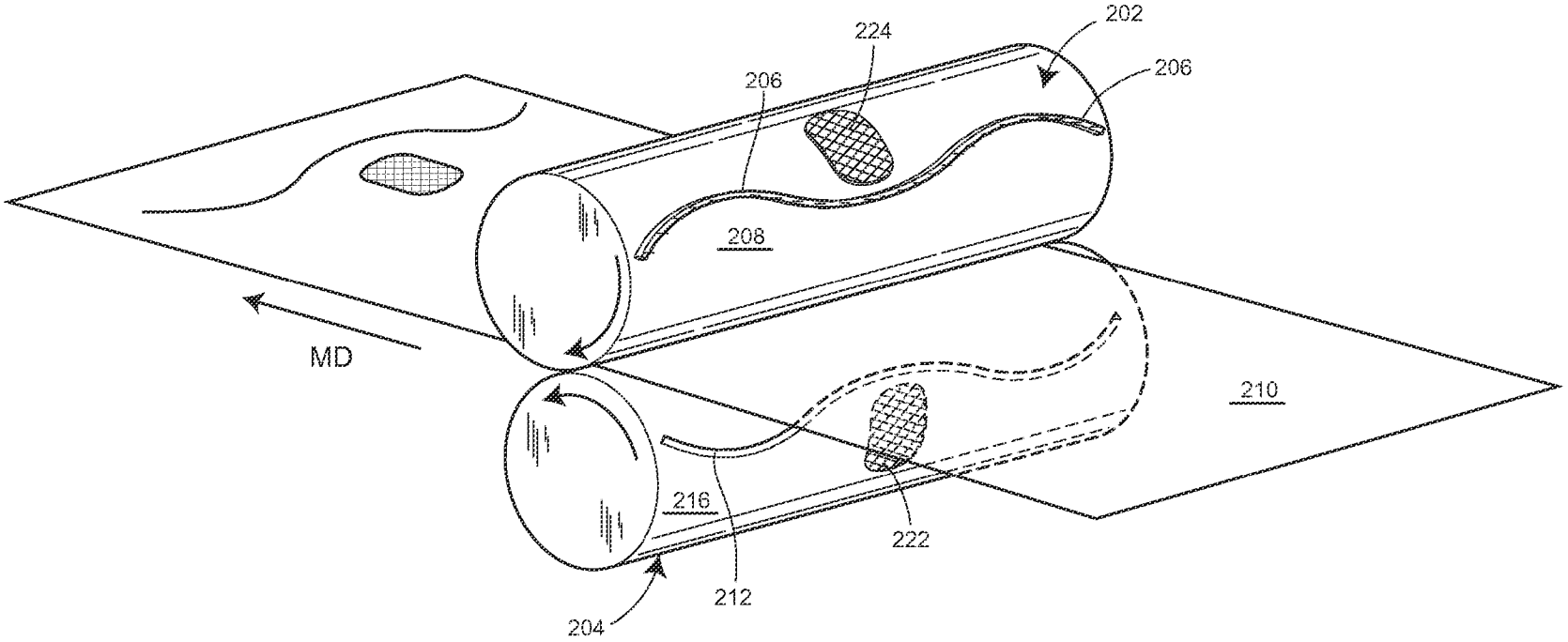
FIG. 5 is an alternative perspective view of an exemplary apparatus for perforating a web including a female emboss pattern on the female roll, a male emboss pattern on the male roll, nonlinear perforating elements on the male roll and a nonlinear pocket in the female roll to receive the nonlinear perforating elements.

As shown in FIG. 1, the perforating elements 206 in a non-limiting example may be disposed from one end 218 to the other end 220 of the male roll 202. The perforating elements 206 also may be disposed in a linear fashion as shown, in a nonlinear fashion as illustrated in FIG. 5, or in any arrangement having both machine and cross directions. In either case, the perforating elements 206 are positioned to be in selected cooperative alignment with an appropriately sized and correspondingly shaped pocket 212.

In other words, the perforating elements 206 are positioned relative to the pocket(s) 212 generally in the manner shown in FIGS. 1 and 5. However, in a broader sense, the perforating elements 206 may be located in a collectively linear fashion as shown in FIG. 1, or in a collectively nonlinear (arcuate) fashion as generally shown in FIG. 5, or in any other desired combination or manner. The only limitation is that each of the perforating elements 206 must be positioned to be received within a corresponding pocket 212.

Thus, simply by selecting the desired location for each of the perforating elements 206, it is possible to produce a perforation pattern which may be linear or may be any nonlinear pattern wherein FIG. 5 is but a single example. The actual location of each of the perforating elements 206 shown in FIGS. 1 and 5 are merely non-limiting examples. As long as one or more pockets 212 may be formed in the female roll 204 to receive every one of the individual perforating elements 206 on the male roll 202, it is possible to produce virtually any desired perforation pattern.

Referring to FIG. 5, the female roll 204 may have a selected female embossing pattern 222 in the outer surface 216. There may also be provided a corresponding male embossing pattern 224 for engagement with the female embossing pattern 222. A selected embossing pattern may thereby be formed on the web 210 by engaging the male and female embossing patterns.

Figure 7:
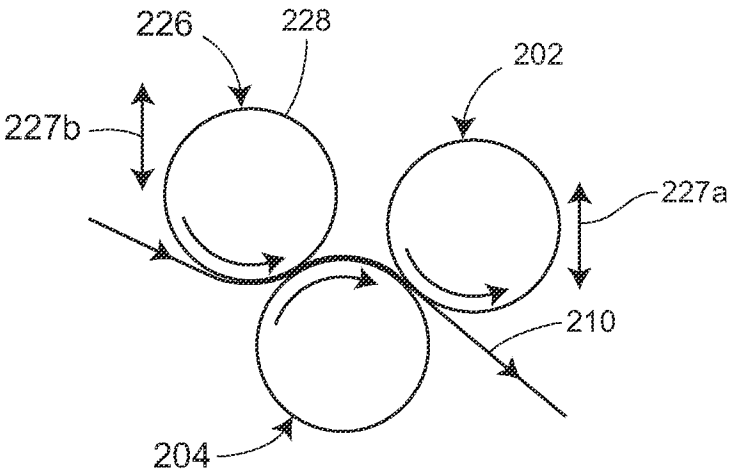
FIG. 7 is an alternative schematic view illustrating separate male rolls for perforating and embossing.

In the non-limiting example of FIG. 5, the male embossing pattern 224 is provided on the outer surface 208 of the male roll 202. However, as shown in FIG. 7, the male embossing pattern may be formed on a rotatable male embossing roll 226. In this manner, both the male perforating roll 202 and the male embossing roll 226 are operatively associated with the female roll 204.

As shown in FIG. 7, the positions of the male perforating roll 202 and the male embossing roll 226 in relation to the female roll 204 are independently adjustable to controllably adjust the perforating and embossing functions as indicated by the arrowed lines 227*a* and 227*b*.

In either case, the pockets 212 in the female roll 204 are located relative to the female embossing pattern 222 so the selected perforation pattern produced by the web engaging edges 206*a* of the perforating elements 206 complements, registers with, or matches the selected embossing pattern produced by the male and female embossing patterns 222 and 224.

As shown in FIG. 5, the male embossing pattern 224 may be formed on the outer surface 208 of the male roll 202 in spaced relation to the perforating elements 206 and positioned such that the female embossing pattern 222 in the outer surface 216 of the female roll 204 will engage the male embossing pattern 224 on the male roll 204 during rotation of the male and female rolls.

Alternatively, the male embossing pattern such as 224 may be formed on the outer surface 228 of the rotatable male embossing roll 226 and positioned so the female embossing pattern 222 in the outer surface 216 of the female roll 204 will engage the male embossing pattern 224 on the male embossing roll 226 during rotation of the female roll 204 and the male embossing roll 226 (FIG. 7).

As shown in FIG. 5, the shape of the selected embossing pattern formed by the female and male embossing patterns 222 and 224, and the selected perforation pattern formed by the shape of the set(s) of perforating elements 206 and the pocket(s) 212 may both be nonlinear and have complementary, registering or matching curvatures or shapes in a non-limiting embodiment.

Referring once again to FIG. 1, the perforating elements 206 on the male roll 202 are disposed generally parallel to an axis of rotation 230 for the male roll 202, and the pocket 212 in the female roll 204 is disposed generally parallel to an axis of rotation 232 for the female roll 204. Further, in this non-limiting embodiment, it will be seen that at least two sets of the perforating elements 206 on the male roll 202 and at least two pockets 212 in the female roll 204 are spaced circumferentially about the outer surfaces 208 and 216 of the male and female rolls, respectively.

Figure 6:
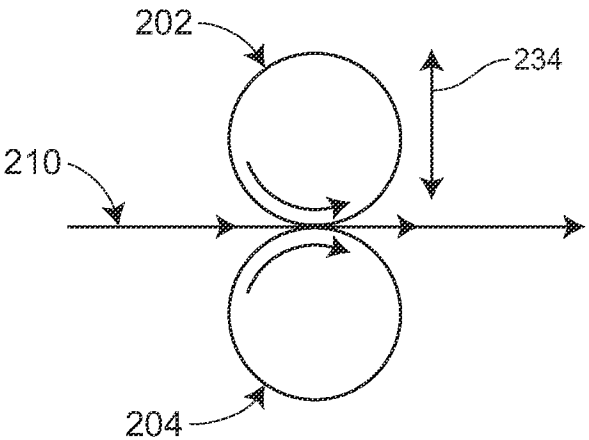
FIG. 6 is a schematic view illustrating one manner of adjusting the apparatus of FIG. 1 to vary the perforations.

Referring to FIG. 6, the degree to which the perforating elements 206 extend into the pocket 212 to be a predetermined depth may be controlled by adjusting the position of the male roll 202 relative to the female roll 204 as represented by the arrow 234. Alternatively, the predetermined depth may be controlled by adjusting the position of the female roll 204 relative to or further away from the male roll 202. Yet still, the degree to which the perforating elements 206 extend into the pocket 212 to be a predetermined depth may be controlled by adjusting the positions of the male roll 202 and the female roll 204 relative to each other.

In addition to adjusting the position of the male roll 202 relative to the female roll 204 to control the degree of web engagement by controlling the extent or predetermined depth to which the perforating elements 206 are received within the pocket 212, the perforating elements 206 may be suitably sized and/or shaped to provide differing degrees of web overstraining when the perforating elements 206 of the male roll 202 are received in the pocket 212 of female roll 204. As another way of controlling the degree of web overstraining, the distance by which the web engaging edges 206*a* defined by the perforating elements 206 are closely spaced from the web supporting edge 214 defined by the pocket 212 may be selected and varied as still another way to control the degree or size of the perforations or weaknesses formed in the web 210.

Figure 8:
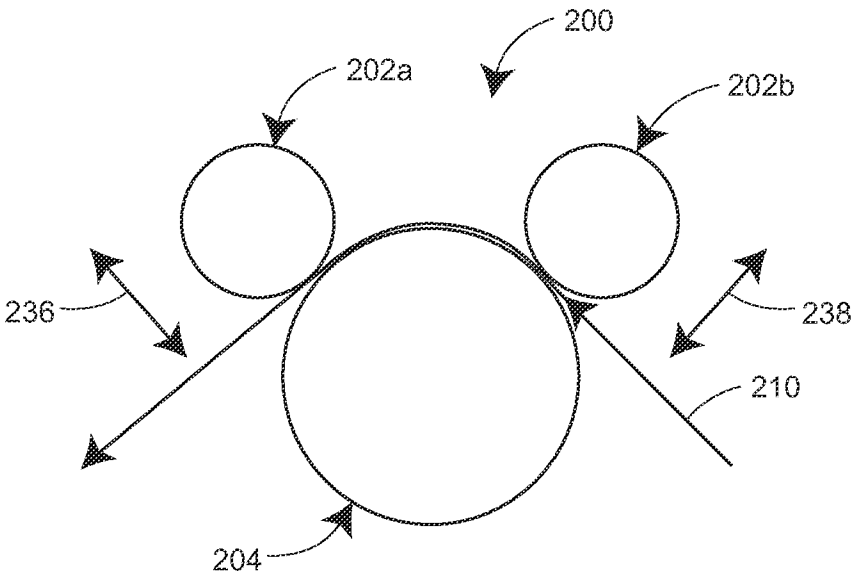
FIG. 8 is a schematic view illustrating two male rolls for perforating a web to form different sheet lengths.

Referring to FIG. 8, another non-limiting embodiment is illustrated in which the apparatus 200 includes a pair of rotatable male rolls 202*a* and 202*b* together with a central rotatable female roll 204. In this connection, each of the male rolls 202*a* and 202*b* will be understood to have perforating elements 206 defining web engaging edges 206*a* spaced outwardly of an outer surface 208 of the type generally illustrated in FIG. 1. With regard to the female roll 204, it will have a pair of pockets 212 each defining a web supporting edge 214 where the pockets 212 extend inwardly of an outer surface 216 generally as illustrated in FIG. 1.

With this arrangement, the perforating elements 206 on the male rolls 202*a* and 202*b* and the pockets 212 in the female roll 204 are located so each of the pockets 212 in the female roll 204 will receive the perforating elements 206 on a different one of the male rolls 202*a* and 202*b* during rotation of the female roll 204 and a selected one of the male rolls 202*a* and 202*b* in an operative position thereof. The male rolls 202*a* and 202*b* are positioned relative to the female roll 204 for movement from an inoperative to an operative position, e.g., through use of linear actuators (indicated by arrows 236 and 238, respectively) in which the web engaging edges 206*a* of the selected one of the male rolls 202*a* and 202*b* extend into one of the two pockets 212 in the female roll 204 to a predetermined depth and are closely spaced from the web supporting edge 214 of the pocket by a distance permitting the web engaging edges 206*a* to overstrain the web 210 to weaken selected areas without contacting the web supporting edge 214. Still additionally, the male rolls 202*a* and 202*b* each have their respective perforating elements 206 located at a circumferential position where they will be received within a different one of the two pockets 212 in the female roll 204 to thereby be able to produce two different perforation pattern formats when they are moved from the inoperative to the operative position relative to the female roll 204.

In this manner, the web engaging edges 206*a* of the perforating elements 206 on each of the male rolls 202*a* and 202*b* is able to cooperate with the web supporting edge 214 of one of the two pockets 212 in the female roll 204. They are arranged to permit the web engaging edges 206*a* to overstrain the web 210 in a manner producing the two different perforation pattern formats, i.e., they are able to produce two different sheet lengths on the web 210. As mentioned, the male rolls 202*a* and 202*b* are each movable between an inoperative and an operative position relative to the female roll 204 to thereby produce a desired one of the two different perforation pattern formats.

While not specifically shown, it will be understood that in each of the two embodiments discussed above, a selected perforation pattern or design can be formed which includes perforations extending not only in the cross direction, but also extending in the machine direction.

Figure 10:
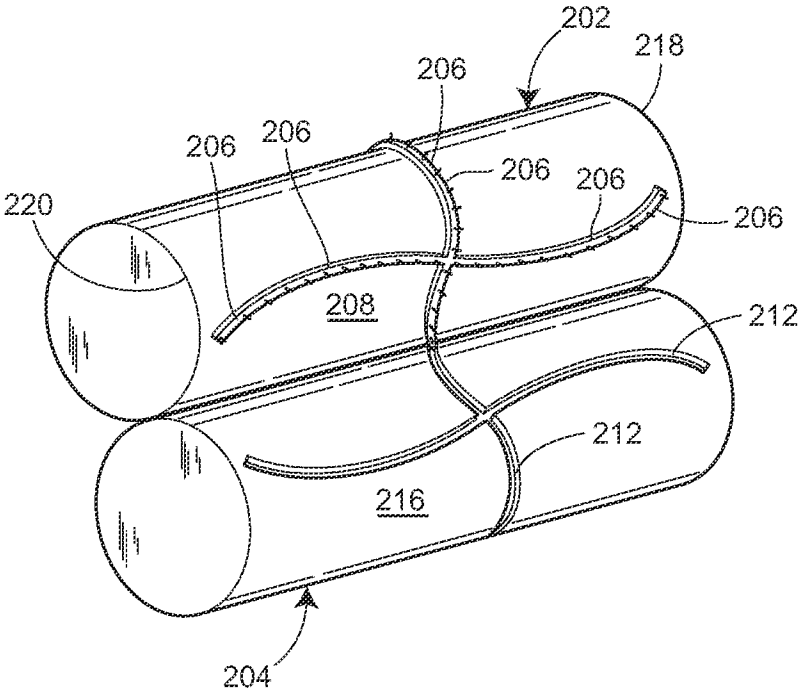
FIG. 10 is a perspective view of an alternative apparatus for perforating a web utilizing a rotatable ring roll and a rotatable pattern roll and having perforating elements and pockets located to form nonlinear perforations in both the cross direction and the machine direction.

In a non-limiting form illustrated in FIG. 10, the apparatus 200 can employ perforating elements 206 and pockets 212 extending generally parallel to the rotational axes of the male and female rolls 202 and 204, respectively, and also generally about the circumference of the male and female rolls 202 and 204, respectively, to form both cross and machine direction perforations.

Figure 9A:
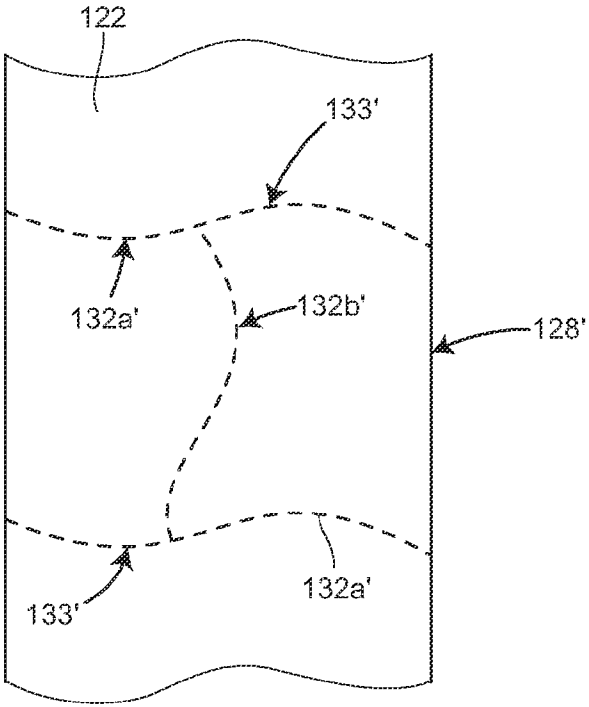
FIG. 9A is a plan view of a web product having a selected perforation design extending in the cross direction as well as in the machine direction utilizing the apparatus of FIG. 1.
Figure 9:
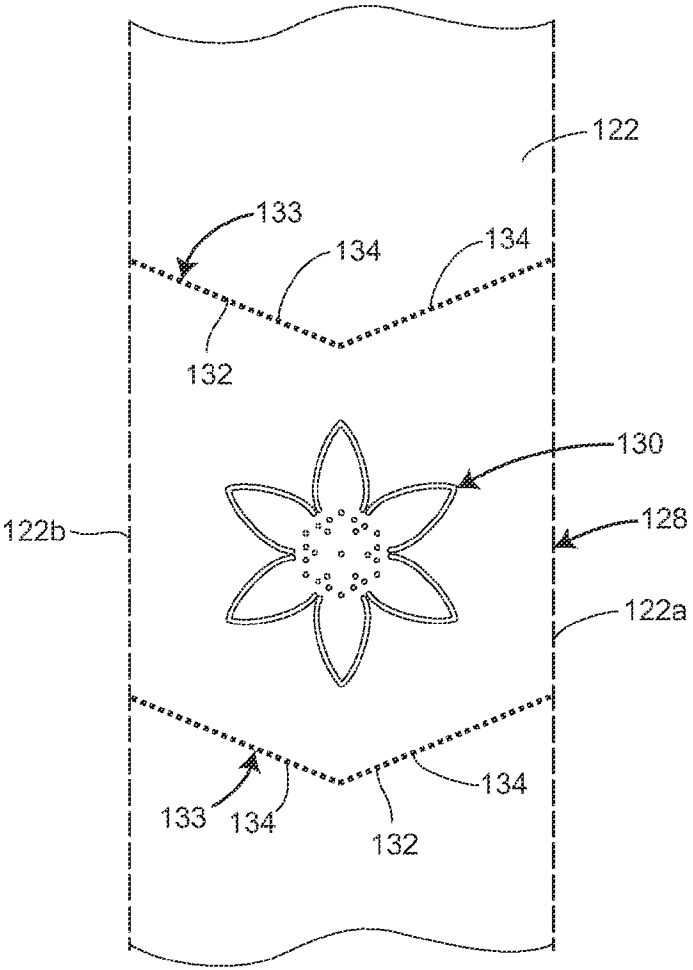
FIG. 9 is a plan view of a web product having an embossed or printed pattern formed thereon and also having a selected perforation design formed utilizing the apparatus of FIG. 1.

Referring to FIG. 9, a single sheet 128 formed on a web 122 by the apparatus 200 and having an embossed or printed indicia or aesthetic pattern 130 is illustrated. The single sheet 128 has a shaped perforation pattern 133 extending generally in the cross direction which may complement, register with, or match the indicia or aesthetic pattern 130, if desired. As shown, the contours of the perforation pattern 133 form a chevron shape which is complementary to the indicia or aesthetic pattern 130 by appropriate arrangement of the perforating elements 206. An exemplary but non-limiting apparatus and process for registering repeating lines of perforation 132 that are formed in web 122 with the indicia or aesthetic pattern 130 are disclosed in U.S. Pat. Nos. 7,222,436 and 7,089,854.

The web 122 may be formed of paper or a like material having one or more plies and having a first side 122*a* and a second side 122*b*. The web 122 may include a plurality of spaced apart and repeating lines of perforation 132. These spaced apart and repeating lines of perforation 132 may either be linear or nonlinear like the shaped perforation patterns 133 in FIG. 9.

As shown in FIG. 9, the repeating lines of perforation 132 may comprise a plurality of individual perforations 134 extending substantially from the first side 122*a* to the second side 122*b* of the web 122. Each one of the plurality of individual perforations 134 is selectively located in relation to the adjacent ones of the individual perforations 134. In this manner, a selected perforation design such as the shaped perforation patterns 133 is provided for each of the repeating lines of perforation 132 which are formed along the web 122 by the apparatus 200.

Still referring to FIG. 9, the sheets such as 128 produced on a web by the apparatus 200 may be formed in such manner that each of the repeating lines of perforation such as 132 is selectively located relative to adjacent ones of the repeating lines of perforation to define a selected perforation pattern format or sheet length. This can be done using a single male roll 202 by varying the diameter of the roll, or locating two or more sets of perforating elements 206 about the circumference of the roll as shown in FIG. 1. In other words, the spacing or distance between the lines of perforation such as 132 which extend generally in the cross direction of a web such as 122 to thereby define a sheet such as 128 on the web may be selected and varied as described in order to form a web product having a desired perforation pattern format or sheet length.

From the foregoing, it will be understood that the apparatus 200 may produce repeating lines of perforation comprising a plurality of individual web overstrain points. The plurality of individual web overstrain points produced with the apparatus 200 form the corresponding individual perforations such as 134 which may extend from the first side such as 122*a* to the second side such as 122*b* of a web such as 122 wherein each one of the plurality of individual web overstrain points is selectively located in relation to adjacent ones of the individual web overstrain points. In this manner, the lines of perforation such as 132 are able to form a selected perforation pattern 133 produced by suitably locating the perforating elements 206. Providing a line of perforation 132 as a plurality of individual web overstrain points extending in the "Z"-direction can provide web 122 with several benefits over those perforations provided by the prior art. By way of non-limiting example, displacing individual fibers of web 122 out of plane can make the lines of perforation more visible to an end user and can be used as a dispensing aid. Additionally, displacing individual fibers of web 122 out of plane can provide more open area proximate to the perforation thereby allowing the use of optical sensors to detect perforations in the web 122 during manufacturing to assist in quality control.

As previously discussed, the sheets such as 128 which are produced by the apparatus 200 may have an embossed or printed aesthetic pattern such as 130 which can be produced in any conventional manner. The selected perforation pattern 133 which is comprised of the perforations such as 134 formed by the plurality of individual web overstrain points may complement, register with, or match the embossed or printed aesthetic pattern such as 130. In addition, the contours of the perforation pattern 133 may be made to take virtually any shape due to the ability to locate each of the perforating elements 206 on the male roll 202 in any desired position.

In one non-limiting embodiment, the web 122 is presented to the consumer as a convolutely wound or rolled paper product. Such a product is suitable for use as paper towels, bath tissue and the like and may have a length in the machine direction of at least 500 inches and most preferably up to at least about 1000 inches. A chop-off cut may be used to terminate one convolutely wound or rolled paper product and start the next product during manufacture.

To achieve the foregoing, the apparatus 200 may further include a chop-off roll 36 and a bedroll 38 downstream of the male roll 202 and female roll 204 to form a chop-off in the manner illustrated and described in U.S. Pat. No. 7,222,436. The perforation pattern formed by the male and female rolls may be linear or non-linear and may or may not extend perpendicular to the machine direction of the web 122. The chop-off may also take various forms although in one non-limiting embodiment it may be shaped rather than straight, e.g., and by way of example only, the chop-off may be chevron shaped, i.e., shaped like the perforation pattern 133 in FIG. 9.

As discussed above, FIG. 9 illustrates lines of perforations 132 that may advantageously take the form of a shaped perforation pattern 133. However, the chop-off roll may be formed so only the chop-off is shaped in the event the lines of perforation 132 extend perpendicular to the machine direction of the web. In this manner, the chop-off may assist the consumer to begin removal of sheets from an exposed end of the convolutely wound or rolled perforated product.

In other words, the chop-off cut at the exposed end of the wound or rolled product such as paper towels, bath tissue, and the like may have the same or a similar shape or design as the lines of perforation 132, or it may have an entirely different shape, e.g., a chevron, by appropriately forming the chop-off roll to provide the desired shape at the end of the last sheet formed on the convolutely wound or rolled perforated product. i.e., the first sheet removed by the consumer.

In a specialized application, the male roll 202 may be formed to have two sets of perforating elements 206 wherein one set produces a perforation pattern that is linear and orthogonal to the machine direction of the web 122 and the other set produces a perforation pattern that is shaped. It is also possible for both of the two sets of perforating elements 206 to be shaped but to have different shapes and/or for each of the two sets to be formed on a different male roll 202 in operative association with the same female roll 204. Depending upon size limitations, it will be appreciated that still other sequences of perforation patterns can be formed by providing two or more sets of perforating elements on two or more male rolls 202 to provide repeating cycles of different perforation patterns in a convolutely wound or rolled paper product.

While not specifically shown, it will be understood that in the embodiments discussed above, a selected perforation pattern or design can be formed on a web which includes perforations extending not only in the cross direction, but also extending in the machine direction. As will be appreciated, this can be achieved by appropriately locating the perforating elements 206 on the male roll 202 in cooperative alignment with corresponding pocket(s) 212 in the female roll 204. In a non-limiting form, the perforating elements 206 may be formed to extend both generally parallel to the rotational axis of the male roll 202, and generally about the circumference of the male roll 202. In this embodiment, the female roll 204 will have correspondingly located pockets 212 whereby all of the perforating elements 206 on the male roll 202 are in alignment with a pocket in the female roll 204 to be received therein.

With regard to the foregoing, and referring to FIG. 10, the male roll 202 may be formed to have perforating elements 206 extending in both the cross direction and the machine direction to thereby mechanically perforate the web 122 in both the cross direction and the machine direction. The male roll 202 may also be used to perforate the web 122 in such manner that some or all of the resulting perforation design is linear and/or non-linear in shape. Referring again to FIG. 10, the male roll 202, as illustrated, has perforating elements located to mechanically perforate the web 122 in both the cross direction and the machine direction such that the resulting perforation design is non-linear in both the cross direction and the machine direction.

Referring to FIG. 9A, a single sheet 128' is illustrated when produced with a male roll 202 having the perforating elements 206 extend non-linearly in both the cross direction and the machine direction. The single sheet 128' as illustrated has a perforation pattern 133' formed by non-linear lines of perforation 132*a'* extending generally in the cross direction and a non-linear line of perforations 132*b'* extending generally in the machine direction. As will be appreciated, the contours of the lines of perforation 132*a'* and 132*b'* can take virtually any form and/or location by appropriate arrangement of the perforating elements 206 on the male roll 202.

In addition to the foregoing, the various embodiments illustrated and described result in improved reliability and lower manufacturing costs while at the same time making it possible to form virtually any desired perforation pattern or design.

In all of the foregoing embodiments and configurations, it will be understood that since the webs may be transported along a path relative to the disclosed apparatus components by a device which may comprise a conventional web rewinder of a type well known in the art, the details of the rewinder and the manner in which it transports the web have not been set forth. Furthermore, the details of the web rewinder are not needed to understand the unique features of the embodiments and configurations disclosed herein and the manner in which they function. Similarly, it will be understood that the details need not be set forth for the controllers, motors, and associated gearing suitable for controlling and driving the various perforating, embossing, and/or printing rolls nor for the controllers for controlling the printing of non-contact printing devices such as inkjet printers and laser printers because they are all well known in the art.

With regard to non-limiting embodiments utilizing multiple rolls, cylinders or blades, it will be understood that they can utilize linear actuators and/or similar components for purposes of engaging and disengaging the various rolls, cylinders and/or similar components in a manner well known to those skilled in the art.

"Fibrous structure" as used herein means a structure that comprises one or more fibrous elements. In one example, a fibrous structure according to the present invention means an association of fibrous elements that together form a structure capable of performing a function.

The fibrous structures of the present invention may be homogeneous or may be layered. If layered, the fibrous structures may comprise at least 2 and/or at least 3 and/or at least 4 and/or at least 5 and/or at least 6 and/or at least 7 and/or at least 8 and/or at least 9 and/or at least 10 to about 25 and/or to about 20 and/or to about 18 and/or to about 16 layers.

In one example, the fibrous structures of the present invention are disposable. For example, the fibrous structures of the present invention are non-textile fibrous structures. In another example, the fibrous structures of the present invention are flushable such as bath paper.

Non-limiting examples of processes for making fibrous structures include known wet-laid papermaking processes, air-laid papermaking processes and wet, solution and dry filament spinning processes that are typically referred to as nonwoven processes. Further processing of the fibrous structure may be carried out such that a finished fibrous structure is formed. For example, in typical papermaking processes, the finished fibrous structure is the fibrous structure that is wound on the reel at the end of papermaking. The finished fibrous structure may subsequently be converted into a finished product, e.g. a sanitary tissue product.

"Fibrous element" as used herein means an elongate particulate having a length greatly exceeding its average diameter, i.e. a length to average diameter ratio of at least about 10. A fibrous element may be a filament or a fiber. In one example, the fibrous element is a single fibrous element rather than a yarn comprising a plurality of fibrous elements.

The fibrous elements of the present invention may be spun from polymer melt compositions via suitable spinning operations, such as meltblowing and/or spunbonding and/or they may be obtained from natural sources such as vegetative sources, for example trees.

The fibrous elements of the present invention may be monocomponent and/or multicomponent. For example, the fibrous elements may comprise bicomponent fibers and/or filaments. The bicomponent fibers and/or filaments may be in any form, such as side-by-side, core and sheath, islands-in-the-sea and the like.

"Filament" as used herein means an elongate particulate as described above that exhibits a length of greater than or equal to 5.08 cm (2 in.) and/or greater than or equal to 7.62 cm (3 in.) and/or greater than or equal to 10.16 cm (4 in.) and/or greater than or equal to 15.24 cm (6 in.).

Filaments are typically considered continuous or substantially continuous in nature. Filaments are relatively longer than fibers. Non-limiting examples of filaments include meltblown and/or spunbond filaments. Non-limiting examples of polymers that can be spun into filaments include natural polymers, such as starch, starch derivatives, cellulose, such as rayon and/or lyocell, and cellulose derivatives, hemicellulose, hemicellulose derivatives, and synthetic polymers including, but not limited to thermoplastic polymer filaments, such as polyesters, nylons, polyolefins such as polypropylene filaments, polyethylene filaments, and biodegradable thermoplastic fibers such as polylactic acid filaments, polyhydroxyalkanoate filaments, polyesteramide filaments and polycaprolactone filaments.

"Fiber" as used herein means an elongate particulate as described above that exhibits a length of less than 5.08 cm (2 in.) and/or less than 3.81 cm (1.5 in.) and/or less than 2.54 cm (1 in.).

Fibers are typically considered discontinuous in nature. Non-limiting examples of fibers include pulp fibers, such as wood pulp fibers, and synthetic staple fibers such as polypropylene, polyethylene, polyester, copolymers thereof, rayon, glass fibers and polyvinyl alcohol fibers.

Staple fibers may be produced by spinning a filament tow and then cutting the tow into segments of less than 5.08 cm (2 in.) thus producing fibers.

In one example of the present invention, a fiber may be a naturally occurring fiber, which means it is obtained from a naturally occurring source, such as a vegetative source, for example a tree and/or plant. Such fibers are typically used in papermaking and are oftentimes referred to as papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. Also applicable to the present invention are fibers derived from recycled paper, which may contain any or all of the above categories of fibers as well as other non-fibrous polymers such as fillers, softening agents, wet and dry strength agents, and adhesives used to facilitate the original papermaking.

In addition to the various wood pulp fibers, other cellulosic fibers such as cotton linters, rayon, lyocell and bagasse fibers can be used in the fibrous structures of the present invention. The fibrous structure or material of the web products which are the subject of this invention may be a single-ply or a multi-ply fibrous structure suitable for being converted into a through air dried perforated product.

With regard to the web products which are the subject of this invention, they may be referred to as "sanitary tissue products" which, as used herein, means a soft, low density (i.e. <about 0.15 g/cm$^3$) web useful as a wiping implement for post-urinary and post-bowel movement cleaning (toilet tissue), for otorhinolaryngological discharges (facial tissue), and multi-functional absorbent and cleaning uses (absorbent towels). The sanitary tissue products may be convolutely wound or rolled upon itself about a core or without a core to form a sanitary tissue product roll. Such product rolls may comprise a plurality of connected, but perforated sheets of fibrous structure, that are separably dispensable from adjacent sheets.

In one example, the sanitary tissue products of the present invention comprise fibrous structures according to the present invention.

"Basis Weight" as used herein is the weight per unit area of a sample reported in lbs/3000 ft$^2$ or g/m$^2$. The sanitary tissue products of the present invention may have a Basis Weight of greater than 15 g/m$^2$ (9.2 lbs/3000 ft$^2$) to about 120 g/m$^2$ (73.8 lbs/3000 ft$^2$) and/or from about 15 g/m$^2$ (9.2 lbs/3000 ft$^2$) to about 110 g/m$^2$ (67.7 lbs/3000 ft$^2$) and/or from about 20 g/m$^2$ (12.3 lbs/3000 ft$^2$) to about 100 g/m$^2$ (61.5 lbs/3000 ft$^2$) and/or from about 30 (18.5 lbs/3000 ft$^2$) to 90 g/m$^2$ (55.4 lbs/3000 ft$^2$). In addition, the sanitary tissue products of the present invention may exhibit a basis weight between about 40 g/m$^2$ (24.6 lbs/3000 ft$^2$) to about 120 g/m$^2$ (73.8 lbs/3000 ft$^2$) and/or from about 50 g/m$^2$ (30.8 lbs/3000 ft$^2$) to about 110 g/m$^2$ (67.7 lbs/3000 ft$^2$) and/or from about 55 g/m$^2$ (33.8 lbs/3000 ft$^2$) to about 105 g/m$^2$ (64.6 lbs/3000 ft$^2$) and/or from about 60 (36.9 lbs/3000 ft$^2$) to 100 g/m$^2$ (61.5 lbs/3000 ft$^2$).

Sanitary tissue products of the present invention may exhibit a Total Dry Tensile value of less than about 3000 g/76.2 mm and/or less than 2000 g/76.2 mm and/or less than 1875 g/76.2 mm and/or less than 1850 g/76.2 mm and/or less than 1800 g/76.2 mm and/or less than 1700 g/76.2 mm and/or less than 1600 g/76.2 mm and/or less than 1560 g/76.2 mm and/or less than 1500 g/76.2 mm to about 450 g/76.2 mm and/or to about 600 g/76.2 mm and/or to about 800 g/76.2 mm and/or to about 1000 g/76.2 mm. In yet another example, the sanitary tissue products, for example single-ply, embossed sanitary tissue products, exhibit a Total Dry Tensile of less than about 1560 g/76.2 mm and/or less than 1500 g/76.2 mm and/or less than 1400 g/76.2 mm and/or less than 1300 g/76.2 mm and/or to about 450 g/76.2 mm and/or to about 600 g/76.2 mm and/or to about 800 g/76.2 mm and/or to about 1000 g/76.2 mm.

The sanitary tissue products of the present invention may exhibit an initial Total Wet Tensile Strength value of less than 600 g/76.2 mm and/or less than 450 g/76.2 mm and/or less than 300 g/76.2 mm and/or less than about 225 g/76.2 mm.

In accordance with the present invention, the web is formed of paper or a like material having one or more plies wherein the material is strong enough to form the wound or rolled product having repeating lines of perforation but weak enough to separate a selected sheet from the remainder of the wound or rolled product. The Perforation Tensile Strength value for sanitary tissue products such as paper towel products, bath tissue products, and the like can be determined by the Perforation Tensile Strength Method described infra.

A single ply paper towel product of the present invention may have a Perforation Tensile Strength value of less than about 150 g/in (1.97 g/76.2 mm), preferably less than about 120 g/in (1.57 g/76.2 mm), even more preferably less than about 100 g/in (1.31 g/76.2 mm), and yet more preferably less than about 50 g/in (0.66 g/76.2 mm). A two ply paper towel product of the present invention may have a Perforation Tensile Strength value of less than about 170 g/in (2.23 g/76.2 mm), more preferably less than about 160 g/in (2.10 g/76.2 mm), even more preferably less than about 150 g/in (1.97 g/76.2 mm), yet more preferably less than about 100 g/in (1.31 g/76.2 mm), even yet more preferably less than about 60 g/in (0.79 g/76.2 mm), and most preferably less than about 50 g/in (0.66 g/76.2 mm). A two-ply bath tissue product of the present invention may have a Perforation Tensile Strength value of less than about 160 g/in (2.10 g/76.2 mm), preferably less than about 150 g/in (1.97 g/76.2 mm), even more preferably less than about 120 g/in (1.57 g/76.2 mm), yet more preferably less than about 100 g/in (1.31 g/76.2 mm), and most preferably less than about 65 g/in (0.85 g/76.2 mm).

The sanitary tissue products of the present invention may exhibit a Density (measured at 95 g/in') of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

"Density" as used herein is calculated as the quotient of the Basis Weight expressed in grams per square meter divided by the Caliper expressed in microns. The resulting Density is expressed as grams per cubic centimeters (g/cm$^3$ or g/cc). Sanitary tissue products of the present invention may have Densities greater than 0.05 g/cm$^3$ and/or greater than 0.06 g/cm$^3$ and/or greater than 0.07 g/cm$^3$ and/or less than 0.10 g/cm$^3$ and/or less than 0.09 g/cm$^3$ and/or less than 0.08 g/cm$^3$. In one example, a fibrous structure of the present invention exhibits a density of from about 0.055 g/cm$^3$ to about 0.095 g/cm$^3$.

"Embossed" as used herein with respect to a fibrous structure means a fibrous structure that has been subjected to a process which converts a smooth surfaced fibrous structure to a decorative surface by replicating a design on one or more emboss rolls, which form a nip through which the fibrous structure passes. Embossed does not include creping, microcreping, printing or other processes that may impart a texture and/or decorative pattern to a fibrous structure. In one example, the embossed fibrous structure comprises deep nested embossments that exhibit an average peak of the embossment to valley of the embossment difference of greater than 600 μm and/or greater than 700 μm and/or greater than 800 μm and/or greater than 900 μm as measured using MicroCAD.

Test Methods

Unless otherwise specified, all tests described herein including those described under the Definitions section and the following test methods are conducted on samples that have been conditioned in a conditioned room at a temperature of 73° F.±4° F. (about 23° C.±2.2° C.) and a relative humidity of 50%±10% for 2 hours prior to the test. If the sample is in roll form, remove the first 35 to about 50 inches of the sample by unwinding and tearing off via the closest perforation line, if one is present, and discard before testing the sample. All plastic and paper board packaging materials must be carefully removed from the paper samples prior to testing. Discard any damaged product. All tests are conducted in such conditioned room.

a. Perforation Tensile Strength Test Method

Principle:

A strip of sample of known width is cut so that a product perforation line passes across the strip perpendicularly in the narrow (width) dimension about equal distance from either end. The sample is placed in a tensile tester in the normal manner and then tensile strength is determined. The point of failure (break) will be the perforation line. The strength of the perforation is reported in grams.

Apparatus:

Conditioned Room: Temperature and humidity controlled within the following limits:

Temperature—73° F.±2° F. (23° C.±1° C.)

Relative Humidity—50% (±2%)

Sample Cutter: JDC Precision Sample Cutter, 1 inch (25.4 mm) wide double edge cutter, Model JDC-1-12 (Recommended), or Model 1 JDC-1-10; equipped with a safety shield, P&G drawing No. A-PP-421; Obtain the cutter from Thwing Albert Instrument Company, 10960 Dutton Road, Philadelphia, Pa. 19154

Cutting Die: (Only for use in cutting samples with the Alpha Cutter) 1.0 inch wide×8.0 inches (25.4×203.2 mm) long on a ¼ inch (19 mm) base; Acme Steel Rule, Die Corp., 5 Stevens St., Waterbury, Conn., 06714, or equivalent. The die must be modified with soft foam rubber insert material.

Soft foam rubber insert material: Polyurethan, ¼ in. (6.3 mm) thick, P-17 Crofteon, Inc., 1801 West Fourth St., Marion, Ind. 46952, or equivalent.

Tensile Tester: Refer to Analystical Method GCAS 58007265 "Testing and Calibration of Instruments—the Tensile Tester"

Tensile Tester Grips: Thwing-Albert TAPPI air grips 00733-95

Calibration Weights Refer to Analytical Method GCAS 58007265 "Testing and Calibration of Instruments—The Tensile Tester"

Paper Cutter.

Rule: Ruler to check gauge length, 6 inch (152.4 mm) metal, with 0.01 inch (0.25 mm) graduations. Cat. #C305R-6, L. S. Starrett Co., Athel, Mass. 01331, or equivalent.

Resealable Plastic Bags: Recommended size 26.8 cm×27.9 cm.

Sample Preparation:

For this method, a usable unit is described as one finished product unit regardless of the number of plies.

Condition the rolls or usable units of product, with wrapper or packaging materials removed, in a room conditioned at 50±2% relative humidity, 73° F.±2° F. (23° C.±1° C.) for a minimum of two hours. For new roll remove at least the outer 8-10 usable units of product and discard. Do not test samples with defects such as perforation skips, wrinkles, tears, incomplete perfs, holes, etc. Replace with other usable unites free of such defects. For roll wipes, condition in sealed package for a minimum of two hours.

Towels:

At all times handle the samples in such a manner that the perforations between the usable units are not damaged or weakened. Prepare the samples for testing using one of the two methods (i.e., a continuous five-usable unit-strip or four two-usable unit strips) described below. For usable units having a length (MD) greater than 8 inches (203.2 mm), either approach may be used in preparing the sample. For usable units having a length (MD) less than or equal to 8 inches (203.2 mm), use only the approach requiring strips of two towels to prepare the samples for testing.

A. Continuous Strip of 5 Towels

For the continuous strip of five towels, fold the second towel approximately in the center so that the perforation between towels one and two lies exactly on top of the perforation between towels two and three. Continue folding the remaining usable units until the four perforations contained in the strip of five towels are exactly coincident in a stack. Using the paper cutter, make cuts parallel to the usable units a minimum of 7 inches (177.8 mm) wide by towel width long with the perforation aligned, parallel to the long dimension of the stack and approximately in its center.

B. Strip of 2 Towels

Where four pairs of usable units have been taken for the samples, stack these usable unit pairs, one on the other, so that their perforations are exactly coincident. Proceed as described above to cut this stack of usable units so that the coincident perforations are in the approximate middle of a 7 inch (177.8 mm) minimum by roll width stack and parallel to the stack long dimension.

Toilet Tissue/Roll Wipes:

At all times the sample should be handled in such a manner that perforations between usable units are not damaged or weakened. Remove four strips of two usable units each whether consecutively or from various positions in the sample.

Lay the four strips, one on top of the other, being very careful that the perforations between the usable unit pairs are exactly coincident. Note: For roll wipes place the remaining wipes in a resealable plastic bag and seal bag. Test roll wipes immediately.

Using either a JDC cutter or a cutting die and Alpha cutter, cut a one-inch (25.4 mm) wide sample strip four finished product units thick in the machine direction of the stack of four thicknesses of product obtained by one of the above techniques (FIG. 2). The result will be a strip of sample four finished product units thick, one-inch (25.4 mm) wide by a minimum of seven inches (177.8 mm) long, having a perforation line perpendicular to the 8 inch (203.2 mm) dimension of the strip and in its approximate center.

Reference Table 1 for preparation and Tensile Tester settings.

TABLE 1

Perforation Strength Preparation

| Sample Description | Number of product units per test | Number of replicates per sample | Load divider | Tensile grip type |
|---|---|---|---|---|
| Towel | 1 | 4 | 1 | Flat |
| Bath Tissue/Roll Wipes | 1 | 4 | 1 | Flat |

Operation:

Reject results from any strip where the sample is not completely broken, preparing a replacement strip for testing as described in Sample Preparation (see examples below).

Towel (Work-to-Tear and Perforation Stretch):

Clamp the sample in the grips of a properly calibrated tensile tester. Determine the tensile strength and perforation stretch of each of the four strips of each sample. Each strip should break completely at the perforation. In cases where an Intelect 500 Tensile Tester is employed, a sensitivity of 0 g should be used to achieve this.

Bath Tissue/Roll Wipes (Perforation Strength and/or Work-to-Tear and Perforation Stretch):

Clamp the sample in the grips of a properly calibrated tensile tester. Determine the tensile strength of each of the four strips of each sample and/or determine the tensile strength and perforation stretch of each of the four strips of each sample. Each strip should break at the perforation. In cases where an Intelect 500 Tensile Tester is employed, a sensitivity of 0 g should be used to achieve this.

Calculations:

Since some tensile testers incorporate computer capabilities that support calculations, it may not be necessary to apply all of the following calculations to the test results. For example, the Thwing-Albert Intelect II STD tensile tester can be operated through its averaging mode for reporting the average perforation tensile strength and average perforation stretch.

Perforation Tensile Strength (All Products):

The perforation tensile is determined by dividing the sum of the perforation tensile strengths of the product by the number of strips tested.

$$\text{Perforation Tensile} = \frac{\text{Sum of tensile results for strips tested (grams)}}{\text{Number of strips tested}}$$

Perforation Stretch:

The perforation stretch is determined by dividing the sum of the perforation stretch readings of the product by the number of strips tested.

$$\text{Perforation Stretch} = \frac{\text{Sum of stretch results for strips tested (\%)}}{\text{Number of strips tested}}$$

"Work"-to-Tear Factor:

$$\text{Work-to-tear Factor } (WTTF) = \frac{\text{Perforation Tensile} \times \text{Perforation stretch}}{100}$$

Perforation Tensile to MD Tensile Ratio (PERFMD) (Tissue only):

$$PERFMD = \frac{\text{Perforation Tensile}}{\text{Average Tensile Strength } (MD)}$$

b. Tensile Strength Test Method

Remove five (5) strips of four (4) usable units (also referred to as sheets) of fibrous structures and stack one on top of the other to form a long stack with the perforations between the sheets coincident. Identify sheets 1 and 3 for machine direction tensile measurements and sheets 2 and 4 for cross direction tensile measurements. Next, cut through the perforation line using a paper cutter (JDC-1-10 or JDC-1-12 with safety shield from Thwing-Albert Instrument Co. of Philadelphia, Pa.) to make 4 separate stacks. Make sure stacks 1 and 3 are still identified for machine direction testing and stacks 2 and 4 are identified for cross direction testing.

Cut two 1 inch (2.54 cm) wide strips in the machine direction from stacks 1 and 3. Cut two 1 inch (2.54 cm) wide strips in the cross direction from stacks 2 and 4. There are now four 1 inch (2.54 cm) wide strips for machine direction tensile testing and four 1 inch (2.54 cm) wide strips for cross direction tensile testing. For these finished product samples, all eight 1 inch (2.54 cm) wide strips are five usable units (sheets) thick.

For the actual measurement of the tensile strength, use a Thwing-Albert Intelect II Standard Tensile Tester (Thwing-Albert Instrument Co. of Philadelphia, Pa.). Insert the flat face clamps into the unit and calibrate the tester according to the instructions given in the operation manual of the Thwing-Albert Intelect II. Set the instrument crosshead speed to 4.00 in/min (10.16 cm/min) and the 1st and 2nd gauge lengths to 2.00 inches (5.08 cm). The break sensitivity is set to 20.0 grams and the sample width is set to 1.00 inch (2.54 cm) and the sample thickness is set to 0.3937 inch (1 cm). The energy units are set to TEA and the tangent modulus (Modulus) trap setting is set to 38.1 g.

Take one of the fibrous structure sample strips and place one end of it in one clamp of the tensile tester. Place the other end of the fibrous structure sample strip in the other clamp. Make sure the long dimension of the fibrous structure sample strip is running parallel to the sides of the tensile tester. Also make sure the fibrous structure sample strips are not overhanging to the either side of the two clamps. In addition, the pressure of each of the clamps must be in full contact with the fibrous structure sample strip.

After inserting the fibrous structure sample strip into the two clamps, the instrument tension can be monitored. If it shows a value of 5 grams or more, the fibrous structure sample strip is too taut. Conversely, if a period of 2-3 seconds passes after starting the test before any value is recorded, the fibrous structure sample strip is too slack.

Start the tensile tester as described in the tensile tester instrument manual. The test is complete after the crosshead automatically returns to its initial starting position. When the test is complete, read and record the following with units of measure:

Peak Load Tensile (Tensile Strength) (g/in)

Test each of the samples in the same manner, recording the above measured values from each test.

Calculations:

Total Dry Tensile(*TDT*)=Peak Load *MD* Tensile(g/in)+Peak Load CD Tensile(g/in)

Tensile Ratio=Peak Load *MD* Tensile(g/in)/Peak Load *CD* Tensile(g/in)

Table 2 below tabulates some measured tensile values of various commercially available fibrous structures.

TABLE 2

Total and Perforation Tensile Strength Values for Various Substrates

| Fibrous Structure | # of Plies | Embossed | TAD[1] | Total Dry Tensile Strength g/76.2 mm | Perforation Tensile Strength g/in |
|---|---|---|---|---|---|
| Charmin ® Basic | 1 | N | Y | 1486 | |
| Charmin ® Basic | 1 | N | Y | 1463 | |
| Charmin ® Ultra Soft | 2 | N | Y | 1457 | 171 |
| Charmin ® Ultra Strong | 2 | Y | Y | 2396 | 190 |
| Cottonelle ® | 1 | N | Y | 1606 | |
| Cottonelle ® | 1 | N | Y | 1389 | |
| Cottonelle ® Ultra | 2 | N | Y | 1823 | 174 |
| Cottonelle ® Ultra | 2 | N | Y | 2052 | |
| Scott ® 1000 | 1 | Y | N | 1568 | 271 |
| Scott ® Extra Soft | 1 | N | Y | 1901 | 176 |
| Scott ® Extra Soft | 1 | Y | Y | 1645 | 223 |
| Bounty ® Basic | 1 | N | Y | 3827 | |
| Bounty ® Basic | 1 | Y | Y | 3821 | |
| Viva ® | 1 | N | Y | 2542 | 153 |
| Quilted Northern ® Ultra Plush | 3 | Y | N | 1609 | 166 |
| Quilted Northern ® Ultra | 2 | Y | N | 1296 | |
| Quilted Northern ® | 2 | Y | N | 1264 | |
| Angel Soft ® | 2 | Y | N | 1465 | 166 |

[1]"TAD" as used herein means through air dried.

With regard to the foregoing parametric values, they are non-limiting examples of physical property values for some fibrous structures or materials that can be utilized for sanitary tissue products that can be formed as a wound or rolled web in accordance with the present invention. These non-limiting examples are materials which are strong enough to enable a wound or rolled web product to be formed having repeating lines of perforation defining a plurality of sheets. Further, these non-limiting examples are materials which are also weak enough to enable a consumer to separate a selected one of the sheets, typically the end sheet, from the remainder of the wound or rolled product by tearing along one of the lines of perforation defining the sheet.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. A method of perforating a web having a first side, second side, a machine direction, a cross-machine direction orthogonal and co-planar thereto, and a Z-direction orthogonal to both the machine and cross machine directions, the method comprising the steps of:

providing a rotatable male roll having perforating elements defining web engaging edges wherein the web engaging edges of the perforating elements are spaced outwardly of an outer surface of the male roll for overstraining the web;

providing a rotatable female roll having a pocket defining a web supporting edge wherein the pocket defining the web supporting edge extends inwardly of an outer surface of the female roll for receiving the web;

locating the perforating elements on the male roll and the pocket in the female roll such that the pocket in the female roll will receive the perforating elements on the male roll during rotation of the male roll and the female roll;

closely spacing the perforating elements from the web supporting edge by a distance selected to permit the web engaging edges to overstrain, but not cut, the web to weaken a selected area of the web without contacting the web supporting edge when the perforating elements are received in the pocket;

positioning the male roll relative to the female roll so the web engaging edges extend the selected area of the web into the pocket to a predetermined depth selected to permit the web engaging edges to overstrain the web to weaken the selected area; and rotating the male roll and the female roll while transporting the web along a path extending between the male roll and the female roll to cause the pocket in the female roll to receive the perforating elements on the male roll; and, whereby a selected perforation pattern is formed by overstraining the web in the Z-direction causing individual fibers comprising the web to move apart and deflect in the Z-direction and outward from a plane formed by the machine and cross machine directions.

2. The method of claim 1 wherein the perforating elements on the male roll are arranged for pushing the web into the pocket in the female roll to force the web against the web supporting edge during rotation of the male and female rolls.

3. The method of claim 2 wherein the pocket extending inwardly of the outer surface of the female roll is larger than the perforating elements extending outwardly of the outer surface of the male roll to permit the perforating elements to be received in the pocket.

4. The method of claim 2 wherein the perforating elements on the male roll and the pocket in the female roll each extend in a generally radial direction relative to the male roll and the female roll, respectively.

5. The method of claim 1 wherein the perforating elements on the male roll are disposed generally parallel to an axis of rotation for the male roll and the pocket in the female roll is disposed generally parallel to an axis of rotation for the female roll.

6. The method of claim 5 including at least two sets of the perforating elements on the male roll and at least two pockets in the female roll spaced circumferentially about the outer surfaces of the male and female rolls, respectively.

7. The method of claim 1 including selecting a non-linear perforation pattern.

8. The method of claim 1 wherein the selected perforation pattern is comprised of perforations extending generally in both the cross direction and the machine direction of the web.

9. A method of perforating a web having a first side, second side, a machine direction, a cross-machine direction orthogonal and co-planar thereto, and a Z-direction orthogonal to both the machine and cross machine directions, the method comprising the steps of:

providing a rotatable male roll having perforating elements defining web engaging edges wherein the web engaging edges of the perforating elements are spaced outwardly of an outer surface of the male roll for overstraining the web;

providing a rotatable female roll having a pocket defining a web supporting edge wherein the pocket defining the web supporting edge extends inwardly of an outer surface of the female roll for receiving the web;

locating the perforating elements on the male roll and the pocket in the female roll such that the pocket in the female roll will receive the perforating elements on the male roll during rotation of the male roll and the female roll;

closely spacing the perforating elements from the web supporting edge by a distance selected to permit the web engaging edges to overstrain, but not cut, the web to weaken a selected area of the web without contacting the web supporting edge when the perforating elements are received in the pocket;

positioning the male roll relative to the female roll so the web engaging edges extend the selected area of the web into the pocket to a predetermined depth selected to permit the web engaging edges to overstrain the web to weaken the selected area;

the web engaging edges of the perforating elements and the web supporting edge of the pocket being arranged to permit the web engaging edges to overstrain the web in the Z-direction causing individual fibers comprising the web to move apart and deflect in the Z-direction and outward from a plane formed by the machine and cross machine directions in a manner producing a selected perforation pattern;

providing a female embossing pattern on the outer surface of the female roll and providing a male embossing pattern for engagement with the female embossing pattern to form a selected embossing pattern on the web;

the web engaging edges and the web supporting edge being located in relation to the respective male and female embossing patterns so the selected perforation pattern is formed in registration with the selected embossing pattern; and rotating the male roll and the female roll while transporting the web along a path extending between the male roll and the female roll to cause the pocket in the female roll to receive the perforating elements on the male roll;

whereby the selected perforation pattern is formed by overstraining the web in a manner complementing, registering with, or matching the selected embossing pattern.

10. The method of claim 9 wherein the perforating elements on the male roll are arranged for pushing the web into the pocket in the female roll to force the web against the web supporting edge during rotation of the male and female rolls.

11. The method of claim 10 wherein the pocket extending inwardly of the outer surface of the female roll is larger than the perforating elements extending outwardly of the outer surface of the male roll to permit the perforating elements to be received in the pocket.

12. The method of claim 10 wherein the perforating elements on the male roll and the pocket in the female roll each extend in a generally radial direction relative to the male roll and the female roll, respectively.

13. The method of claim 9 wherein the perforating elements on the male roll are disposed generally parallel to an axis of rotation for the male roll and the pocket in the female roll is disposed generally parallel to an axis of rotation for the female roll.

14. The method of claim 9 wherein the male embossing pattern is formed on the outer surface of the male roll in spaced relation to the perforating elements and positioned such that the female embossing pattern on the female roll will engage the male embossing pattern on the male roll during rotation of the female and male rolls.

15. The method of claim 9 wherein the male embossing pattern is formed on the outer surface of a separate rotatable embossing roll positioned such that the female embossing pattern on the female roll will engage the male embossing pattern on the embossing roll during rotation of the female and embossing rolls.

16. The method of claim 9 wherein the selected embossing pattern and the selected perforation pattern are both arcuate.

17. The method of claim 9 wherein the selected perforation pattern is comprised of perforations extending generally in both the cross direction and the machine direction of the web.

* * * * *